United States Patent [19]

Nelson

[11] Patent Number: 4,611,149

[45] Date of Patent: Sep. 9, 1986

[54] BEAM TUBE WITH DENSITY PLUS VELOCITY MODULATION

[75] Inventor: Richard B. Nelson, Los Altos Hills, Calif.

[73] Assignee: Varian Associates, Inc., Palo Alto, Calif.

[21] Appl. No.: 669,206

[22] Filed: Nov. 7, 1984

[51] Int. Cl.[4] ..... H01J 25/00

[52] U.S. Cl. ..... 315/5.39; 315/4; 315/5; 315/5.29; 315/5.32; 313/293; 332/7

[58] Field of Search ..... 313/293; 315/4, 5, 5.29, 315/5.39, 5.32, 5.37; 332/7

[56] References Cited

U.S. PATENT DOCUMENTS

| | | | |
|---|---|---|---|
| 2,842,742 | 7/1958 | Preist | 332/7 |
| 3,295,066 | 12/1966 | Anderson | 332/58 |
| 3,483,420 | 12/1969 | Lien et al. | 315/5.51 |
| 3,521,117 | 7/1970 | Schmidt | 315/5.51 |
| 4,480,210 | 10/1984 | Preist et al. | 313/293 |

*Primary Examiner*—David K. Moore
*Assistant Examiner*—M. Razavi
*Attorney, Agent, or Firm*—Stanley Z. Cole; Richard B. Nelson

[57] ABSTRACT

A tube for amplifying high-frequency multi-kilowatt, amplitude-modulated signals utilizes a linear beam of electrons which is density-modulated by a permeable control grid spaced close to a thermionic cathode. The beam is focused through a drift tube having two axially spaced gaps, each coupled to a resonant circuit such as a hollow cavity. The first circuit is tuned to a resonant frequency higher than the signal frequency to produce velocity-modulation bunching of the beam electrons in phase with the density-modulation from the grid. The second circuit is tuned to the signal frequency and its energy is coupled out to an external load. The grid modulation is Class B or Class C so there is no current between the electron bunches. The floating bunching circuit can thus, by velocity modulation, produce very dense bunches to excite the output circuit, providing very high conversion efficiency. The tube is particularly adapted to amplitude-modulated signals such as television, for which a conventional klystron yields very low average efficiency.

15 Claims, 3 Drawing Figures

BEAM TUBE WITH DENSITY PLUS VELOCITY MODULATION

FIELD OF THE INVENTION

The invention pertains to power amplifiers for high frequency amplitude-modulated signals such as television picture signals. UHF television transmitters now usually use klystrons as the output amplifiers. The dc beam current in a klystron must be sufficient to generate the modulation peak power, such as the synchronization pulses. Due to the amplitude modulation, the time-averaged rf power required is much lower than this, so the efficiency is much less than the saturation efficiency of the klystron.

PRIOR ART

Various attempts have been made to improve the efficiency of klystrons for amplitude-modulated signals. One early proposal was to modulate the dc beam current at a video frequency in proportion to the modulated amplitude of the rf signal, so the klystron could always be running near its saturation drive. This scheme has not been very successful because the circuitry is complex, the video modulation power is high, and phase distortions occur.

A more sophisticated scheme is described in U.S. patent application Ser. No. 377,498 of Donald H. Preist and Merrald B. Shrader, filed May 12, 1982 and now allowed and now U.S. Pat. No. 4,480,210. This application is included by reference in the present application. It contains all the most pertinent prior art. Briefly, its invention is to grid-modulate an electron beam in a Class B or Class C manner such that the current is pulsed at the radio-frequency and its amplitude envelope is proportional to the video-frequency signal. The beam passes through a drift tube and is coupled as in a klystron to a resonant output cavity. The time-average efficiency is greatly improved compared to a klystron and the circuitry is relatively simple.

There are a few limitations to the Preist-Shrader tube. A linear modulation characteristic is obtainable with Class B operation. However, the electron bunches leaving the grid are about ½ cycle long and the rf component of beam current is limited as known in classical triode theory. Furthermore, as the bunches progress down the beam, they are spread out by their own space-charge repulsion forces, further reducing the rf current component, as known from classical klystron theory. As described in the referenced application, the drift space between the electron gun and the output interaction gap should have at least a prescribed length to minimize rf wave leakage into the cathode-grid region. This gives more time for space-charge debunching.

SUMMARY OF THE INVENTION

The object of the invention is to provide an amplifier for amplitude-modulated high frequency signals having improved average efficiency.

This object is achieved by a tube which generates a linear electron beam from a thermionic cathode, modulated into discrete bunches by a close spaced electron-permeable grid. The grid is biased for Class B modulation. The beam is drawn through a drift tube where it interacts with the rf voltages on two gaps. The first gap is part of a klystron-type cavity resonant above the operating frequency to produce velocity-modulation bunching in phase with the density modulation emanating from the grid. The velocity modulation makes the electron bunches tigther, increasing the rf component of beam current even above that originally produced by the grid. The second gap is part of a klystron-type cavity coupled to an external load to generate output energy.

DESCRIPTION OF THE PREFERRED EMBODIMENTS

Figure 1:
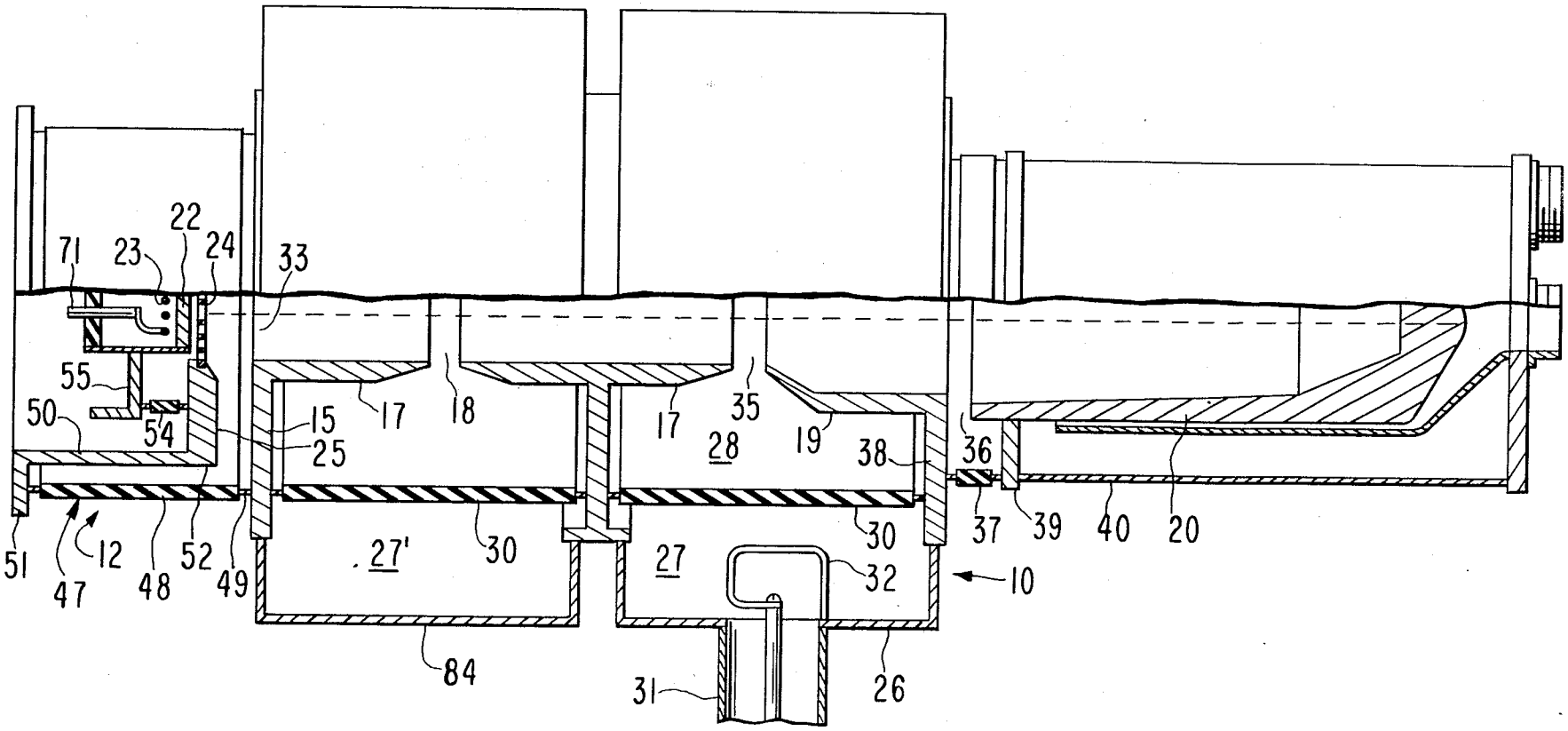
FIG. 1 is a partial section through the axis of a tube embodying the invention.

FIG. 1 is a schematic section of an external-cavity tube embodying the invention.

FIG. 1 shows an elongated electron tube 10 defining a longitudinal axis which structurally is fairly analgous to that of a typical klystron, but which functions quite differently. Its main assemblies include a generally cylindrical electron gun and signal input assembly 12 at one end, a segmented tubular wall including ceramic 30 and copper 15, 43 portions defining a vacuum envelope, an axially apertured anode 15, which is extended axially to become a drift tube 17 interrupted by two gaps 18, 35, and a collector 20 at the other end of tube 10, all axially centered and preferably of copper.

The gun assembly 12 includes a flat disc-shaped thermionic cathode 22 of the tungsten-matrix Philips type, back of which a heating coil 23 is positioned; a flat electron-beam modulating grid 24 of a form of temperature-resistant carbon, preferably pryrolitic graphite; and a grid support and retainer subassembly 25 for holding the grid very accurately but resiliently in a precisely predetermined position closely adjacent the cathode 22. The cathode and grid are of relatively large diameter, to produce a correspondingly sized cylindrical electron beam and high beam current. A still larger cathode could be utilized with a convergent beam, as well-known in other tubes. Either higher power could be obtained, or reduced cathode current density, along with a resulting longer lifetime.

A reentrant, coaxial, resonant rf output cavity 26 is defined generally coaxially of both drift tube portions 17, 19 intermediate gun 12 and collector 20 by both a tuning box 27 outside the vacuum envelope, and the interior annular space 28 defined between the drift tubes and the ceramic 30 of the tubular envelope extending over much of the axial extent of the drift tube 17. Tuning box 27 is equipped with an output means including a coaxial line 31, coupled to the cavity by a simple rotatable loop 32. This arrangement handles output powers on the orders of tens of kilowatts at UHF frequencies. Higher powers may require integral output cavities as described below, in which the entire resonant cavity is within the tube's vacuum envelope; a waveguide output could also be substituted. Although the preferred embodiment utilizes reentrant coaxial cavity 26, other resonant rf output means could be coupled across gap 35 which also would function to convert electron beam density-modulation into rf energy.

An input modulating signal with a carrier frequency of at least the order of 100 MHz and several watts in power is applied between cathode 22 and grid 24, while a steady dc potential typically of the order of between 10 and 30 kilovolts is maintained between cathode 22 and anode 15, the latter preferably at ground potential. The modulating carrier signal frequency can be lower as well as higher, even into the gigahertz range. In this manner, an electron beam of high dc energy is formed and accelerated toward the aperture 33 of anode 15 at high potential, and passes therethrough with minimal interception. Electromagnetic coils or permanent magnets (not shown) positioned about the gun area outside the vacuum envelope, and about the downstream end of tail pipe 19 and the initial portion of collector 20, provide a magnetic field to aid in confining or focusing the beam to a constant diameter as it travels from the gun to the collector, and in assuring minimal interception through the anode aperture 33 and drift tube 17. However, the magnetic field, although desirable, is not absolutely necessary, and the tube could be electrostatically focused, as with certain klystrons.

A dc bias is applied between cathode 22 and grid 24 such that current is drawn through grid 24 only during the positive half of the rf modulation cycle. In gridded tube art this is commonly known as "Class B" modulation. For a fine-mesh grid with high amplification factor, the bias may be zero. The rf signal is also modulated in amplitude by a video-frequency signal, which provides that the radio-frequency pulses of electron current have an amplitude envelope representing the video signal. In Class B operation, the video-frequency component of beam current is a smooth monotonic function of the video signal amplitude. This is a requirement for television transmission. Deviations from absolute linearity can be compensated by non-linear circuitry.

It would be possible to apply a negative grid bias so that beam current would be drawn over less than half of the rf cycle, known as "Class C" modulation. The rf current pulses would be shorter and the rf component fraction of beam current higher, resulting in higher efficiency. However, the current would not be a smooth function of video amplitude unless very complex modulation circuitry were added. Therefore, Class B modulation is generally preferable. The density-modulated beam, after it passes through anode 15, then continues through a field-free region defined by the hollow interior of drift tube 17 at constant velocity, to eventually pass across an output gap 35 defined between drift tube 17 and tail pipe 19. Drift tube 17 and tail pipe 19 are isolated from each other by gap 35, as well as by tubular ceramic 30 which defines the vacuum envelope of the tube in this region. Gap 35 is also electrically within resonant output cavity 26. Passage across gap 35 of the bunched electron beam induces a corresponding electromagnetic-wave rf signal in the output cavity which is highly amplified compared to the input signal, since much of the energy of the electron beam is converted into microwave form. This wave energy is then extracted and directed to a load via output coaxial line 31.

After passage past gap 35, the electron beam enters tail pipe drift tube 19, which is electrically isolated from collector 20 by means of second gap 36 and tubular ceramic 37. The ceramic 37 bridges the axial distance between copper flange 38 supporting the end of tail pipe 19, and copper flange 39 centrally axially supporting the upstream portion of collector 20. Thus, the beam passes through the tail pipe region with minimal interception, to finally traverse second gap 36 into the collector, where its remaining energy is dissipated. Collector 20 is cooled by a conventional fluid cooling means, including water jacket 40 enveloping the collector and through which fluid, such as water, is circulated. Similarly, anode 15 and tail pipe 19 may be provided with fluid cooling means (not shown). Although described as a unitary element in the preferred embodiment, it should be understood that collector 20 could also be provided as a plurality of separate stages.

The construction of electron gun assembly 12 at one end of the tube is especially adapted for effecting broadband efficient rf density modulation of the electron beam. It includes both the control grid 24 and grid support means 25, as well as a high-isolation low-impedance signal input means 47, by which not only the rf modulating signal of at least several watts power and at least megahertz frequency is led into the control grid, but also by which the kilovolt level dc beam accelerating potential is applied to the cathode.

The outermost element of signal input means 47 is a tubular or annular ceramic insulator 48, axially comparatively shallow compared to its diameter, and which is at one end 49 thereof hermetically sealed to anode 15, and which is axially centered radially outwardly of anode aperture 33. An annular conductive sleeve 50 has a trailing end 51 at which the rf control signal is accepted, is roughly of diameter comparable to ceramic 48, and extends axially rearwardly of insulator 48. Sleeve 50 is supported on ceramic 48 by being mounted coaxially thereto at its trailing end 51. From end 51, sleeve 50 extends axially and generally radially inwardly toward anode 15, to terminate in a leading end 52. Leading end 52 of sleeve 50 is reduced radially inwardly to a relatively small diameter less than that of insulator 48 or anode 15. By means of an inner, axially relatively shallow, annular insulator 54, there is mounted to, and concentrically within, leading end 52 the annular metallic cathode lead-in 55, recessed toward leading end 52 well inwardly of outer conductive sleeve 50.

All joints are vacuum-tight since the volume within outer insulator 48, sleeve 50, and cathode lead-in 55 is within the evacuated portion of the tube. Metallic sleeve 50, preferably of relatively thick copper, serves both as the rf signal lead-in path to grid 24, and also as the ultimate grid support member along with insulator 48. The axial length of any coaxial current paths compared to their diameter is small, while their radial and axial spacing, both due to geometry and the interposition of insulators, is comparatively large, thus minimizing series inductance and shunt capacitance effects. A very low reactance to the modulating rf signal results, contributing to high overall bandwidth. The cathode-grid input circuit connected to the electrodes is typically a coaxial resonator apparatus.

In order to handle the relatively large beam currents required to yield relatively high power output, the grid, cathode and beam cross-sections are relatively large in area, thus keeping current density over the grid and cathode to reasonable levels. As mentioned above, this increased area may be provided by means of a convergent electron gun having a spherical or concave cathode surface and a correspondingly-shaped grid, as seen in other linear-beam tubes. At the same time, the need to minimize electron transit time loading in order to obtain high efficiency and bandwidth, with high upper frequency limits, requires the grid to be one which is as thin as possible compared to its diameter, and to be as closely spaced as possible to the cathode. The grid-to-cathode spacing achievable by the present invention is on the order of one-twentieth the diameter of the grid or less, while the thickness of the grid is on the order of half this distance or less. Such a relatively thin, closely spaced grid would heretofore have been considered impracticable as subject to failure due to shorts, or to changes in operating characteristics, or to mechanical breaks under the heat and differential expansion stresses imposed by the operating environment. Such grid-to-cathode spacing has been reduced far beyond even the foregoing values, having been brought down to about one-hundredth of the grid diameter.

In the associated signal input means 47, the cathode lead-in member 55 is of a diameter smaller than reduced end 52, and on the order of half the diameter of outer insulator 4, or less. The extra degree of physical separation enhances the isolation between the rf signal and the dc beam accelerating potential for the cathode. Cathode lead-in 55 is mounted within leading end 52 of grid lead-in 50 by means of the inner ceramic annular insulator 54 therebetween. The insulator 54 not only isolates the cathode lead-in 55 from the rf present at grid 24 and grid support 25, but also forms part of the vacuum envelope of the gun assembly, as mentioned above.

Just inside cathode 22 are heater elements 23. These may, for example, be spiral or in any other conventional form; their support and electrical lead-in wires extend parallel to the tube central axis, to terminate in pin 71 which is hermetically sealed to cathode lead-in member 55 via a ceramic seal which seals off the gun assembly and completes the vacuum envelope of the gun and tube.

The above described portions of FIG. 1 are basically the invention of U.S. patent application Ser. No. 377,498. That invention has provided astonishing improvement in the efficiency of UHF television transmitters. Efficiencies have reached around 70%, several times that of conventional klystron transmitters. However, as mentioned above, there are still two fundamental limitations to the efficiency.

In Class B grid modulation, the rf pulse of current inherently lasts 180 degrees of phase of the carrier signal. The maximum possible fundamental frequency component of beam current may be calculated using some simplifying assumptions. For a Class B triode, the maximum efficiency can approach a limit of $\pi/4$.

As the bunches of electrons flow down the drift tube each bunch is spread out by the repulsive force of its own space charge. The initial drift tube of the Preist-Shrader tube must have a certain minimum length compared to its diameter to prevent rf electric field from the cavity leaking into the region between anode and grid where it could cause harmful regeneration. This minimum length depends on the gain of the tube, but in a practical case should probably be at least twice the drift tube bore diameter. The space-charge debunching is complex to calculate. In klystron and traveling-wave tube theory, equations are derived for small-signal modulation of a dc beam. For on-off modulation as by a grid in the Priest-Shrader tube, computer simulation of an assumed model must be carried out for each particular design. Results of such calculations are described in U.S. Pat. Nos. 3,622,834 and 3,811,065 issued Nov. 23, 1971 and May 14, 1974 to Erling L. Lien. These calculations are for klystrons in which an initially continuous beam is bunched by velocity modulation.

Figure 2:
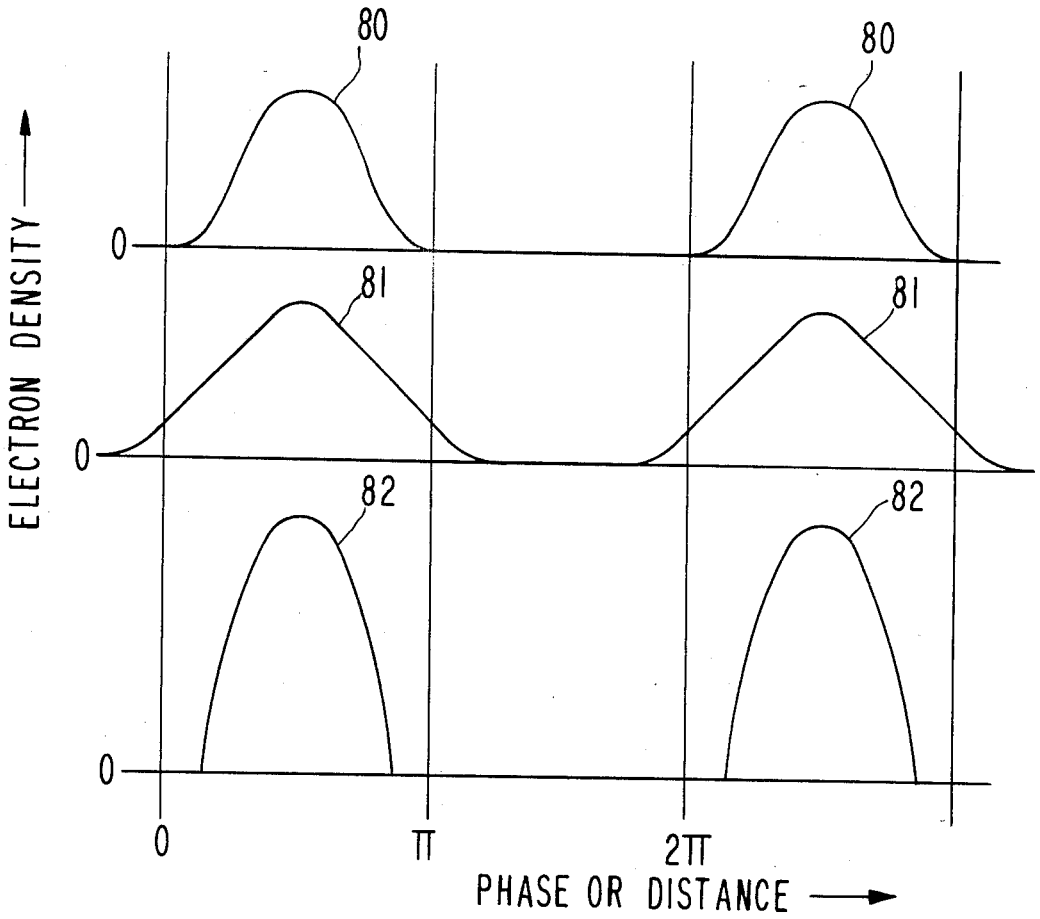
FIG. 2 is a schematic graph of the electron bunch densities in the tube of FIG. 1.

The first two curves of the schematic graph of FIG. 2 illustrate the electron density in a bunch as it progresses down the drift tube of the Preist-Shrader tube. The horizontal dimension is the rf phase (time) of electrons passing a given point, but it may be considered also as the instantaneous distribution in the axial dimension because all electrons have approximately the same axial velocity. Curve 80 is the distribution in the bunch as it leaves the grid, for an electron gun with high amplification factor and grid biased at cutoff so that current flows for exactly one half of the cycle. Curve 81 is the distribution at the drift-tube gap after the bunch is broadened by space charge repulsive forces. Curve 82 is the final bunch produced by the present invention wherein a second interaction gap is introduced between the anode and the output gap and its coupled resonant circuit is made resonant at a frequency higher than the signal frequency. The second gap produces a velocity modulation of the electron stream. As is well known in klystron theory, a sinusoidal velocity-modulating voltage will produce, downstream, bunches having maximum electron density centered on an electron which crosses the modulating gap at an instant when the modulating voltage is zero and changing from decelerating to accelerating. The increase in the bunch density of the original density-modulated beam is greatest when the bunching produced by the velocity modulation is in phase with the bunching of the original density-modulated bunches. To do this the decelerating voltage across the first gap is made to be in a phase $\pi/2$ radians ahead of the phase of the arriving grid-modulated bunches which excite the circulating current in the resonant circuit coupled to this first gap. This phase relationship is produced when the circuit is resonant at a frequency higher than the signal.

When these relationships are fulfilled, the original density modulated bunch can be compressed even beyond its original 180 degree extent as shown by curve 82, providing increased rf beam current and hence increased output efficiency. In fact, the rf current component can also be made higher than in a klystron because there are no residual electrons left in between the bunch maxima.

Returning to FIG. 1, there is illustrated an apparatus for carrying out the invention.

An intermediate gap 18 in drift tube 17 is coupled to a second resonant cavity 84 surrounding drift tube 17. Cavity 84 is similar to output cavity 26 except that it has no external rf coupling such as output coupler 31. Also, its resonant frequency is higher than that of output cavity 26, which is tuned to the signal frequency. It is necessary that the velocity modulation voltage of the intermediate gap be the correct amplitude to produce maximum bunching at the output gap. This can conveniently be done by adjusting the amount by which the resonant frequency of intermediate cavity 84 is above the signal frequency. A mechanical tuner (not shown) may be a part of external cavity 27'.

Figure 3:
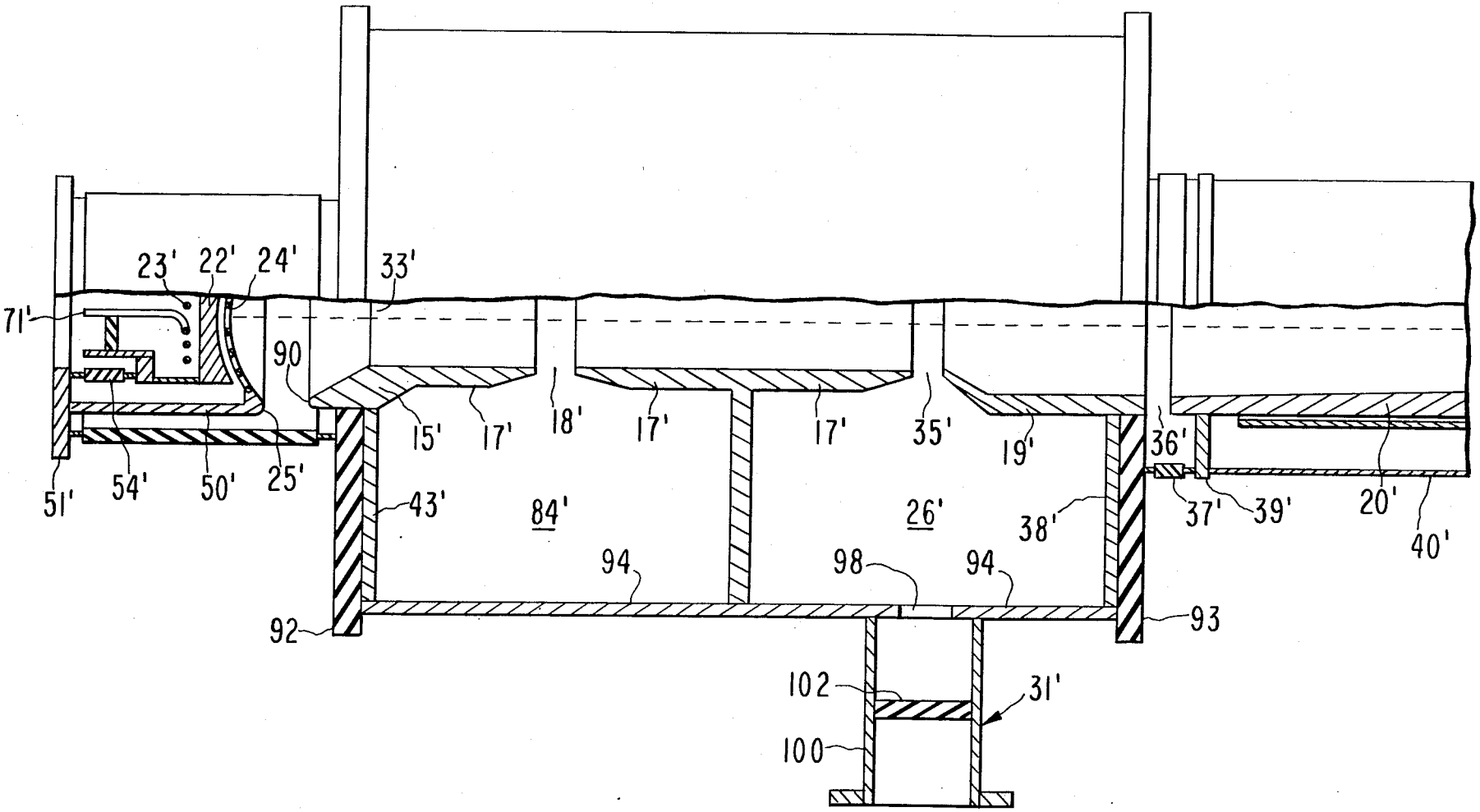
FIG. 3 is an axial section of an alternative embodiment.

FIG. 3 is a schematic section containing the axis, of a somewhat different embodiment. Most of the elements are direct counterparts of those in the embodiment of FIG. 1, indicated by primed numbers. The elements differing from FIG. 1 are adapted for generation of higher power, such as 100 kilowatts. The cathode 22' has a concave spherical emissive surface to produce a convergent beam of electrons. Thus for a given size of final beam the emitting area may be much larger than the beam area. Area convergence of one to two orders of magnitude is common in the klystron art. The grid 24' is also spherical with a radius to provide uniform spacing from cathode 22'. Fabricating such a grid from pyrolytic graphite is complex, but not beyond the state of the art. Anode 15' has a nose 90 extending toward cathode 22' to provide converging electric field. Also the front side of grid support 25' is shaped to form a Pierce-type focusing electrode, as is well known in the art.

The two cavities 26', 84' are integral. That is, the cavity walls 43' and 94 form parts of the vacuum envelope. There is no internal dielectric such as 30 (FIG. 1) exposed to the high rf field of the cavities. The output coupling 31' is by an iris 98 in the wall 94 of output cavity 26', feeding into a rectangular waveguide 100 which is vacuum sealed by a dielectric window 102.

The internal-cavity tube of FIG. 3 could have tuners (not shown) using capacitive plates, movable near gaps 18' and 35' via vacuum-sealed flexible metal bellows.

To provide controlled focusing of the electron beam in its interacting length and still allow rapid convergence in the cathode region and divergence in the collector region, the tube of FIG. 3 is provided with a pair of integral ferromagnetic polepieces 92, 93. Polepieces 92, 93 are in this example part of the vacuum envelope. They have central apertures for passage of the beam which are small enough that not much magnetic flux leaks out from the high axial field between polepieces 92, 93. Polepieces 92, 93 extend radially past outer cavity walls 94 to make magnetic connection to iron-shielded solenoid coils (not shown) surrounding the tube.

In the referenced Patent Application Ser. No. 377,498 mention is made of the possibilty of adding intermediate cavities to increase the tube's bandwidth. To do so requires a plurality of cascaded cavities stagger-tuned within the desired pass-band. Unlike this, the efficiency-enhancing intermediate cavity 84 of the present invention has essentially no effect on the bandwidth. To perform its function its resonance is well outside the desired passband so that it has an inductive reactance at all signal frequencies. The overall bandwidth of the inventive tube as described appears to be adequate for the present foreseen use, which is television broadcasting. The grid driving circuit, typically a coaxial resonator, is heavily loaded by the input transconductance of the grid-cathode modulation. The output circuit is heavily loaded by the output power coupling. The intermediate cavity has a fairly narrow resonance but the passband is on the broad inductive shirt.

It will be obvious to those skilled in the art that many embodiments of the invention are possible. The above examples are intended to be illustrative and not limiting. The invention is intended to be limited only by the following claims and their legal equivalents.

What is claimed is:

1. A high-frequency amplifier tube comprising:

a vacuum envelope;

a gun for generating a linear beam of electrons, said gun comprising a thermionic cathode, means for heating said cathode, and an electron-permeable grid insulated from said cathode and spaced close to the emissive surface of said cathode;

means for applying a radio-frequency input signal voltage between said cathode and said grid and biasing said grid so that beam current is drawn over approximately ½ of the radio-frequency cycle;

anode means for drawing a beam of electrons from said gun, said anode means comprising an aperture for passage of said beam through an extended hollow metallic drift tube;

collector means beyond the end of said drift tube opposite said anode for collecting said electrons and dissipating their remaining energy;

output circuit means for extracting rf energy from said beam comprising, a transverse output gap in said drift tube, means for coupling a resonant output circuit across said gap, and means for extracting energy from said resonant circuit;

the improvement wherein being means for increasing the efficiency of said tube, comprising a second gap in said drift tube on the anode side of said output gap, and means for coupling across said second gap an intermediate circuit resonant at a frequency above the operating frequency band of said tube.

2. The tube of claim 1 wherein said output circuit is a hollow resonant cavity.

3. The tube of claim 1 wherein said intermediate circuit is a hollow resonant cavity.

4. The tube of claim 2 wherein said means for coupling said output circuit across said output gap comprises:

a pair of conductive members, each extending outwardly from said drift tube, on opposite sides of said output gap;

a hollow dielectric window surrounding said drift tube and sealed vacuum tight between said conductive members, and means for electrically joining the outer portions of said conductive members to apertured ends of an external conductive cavity.

5. The tube of claim 3 wherein said means for coupling said intermediate circuit across said second gap comprises:

a pair of conductive members, each extending outwardly from said drift tube, on opposite sides of said second gap;

a hollow dielectric window surrounding said drift tube and sealed vacuum tight between said conductive members, and means for electrically joining the outer portions of said conductive members to apertured ends of an external conductive cavity.

6. The tube of claim 2 wherein said output resonant cavity is a vacuum tight conductive cavity surrounding said gap and sealed to said drift tube on opposite sides of said output gap.

7. The tube of claim 3 wherein said intermediate resonant cavity is a vacuum tight conductive cavity surrounding said second gap and sealed to said drift tube on opposite sides of said second gap.

8. The tube of claim 1 further comprising means for supporting a steady magnetic field along said drift tube.

9. The tube of claim 8 wherein said means for supporting magnetic field comprises:

a pair of ferromagnetic polepieces apertured for passage of said beam, one of said polepieces disposed near said anode and cathode and the other disposed near the entrance to said collector means;

and means for magnetically coupling said polepieces to an electromagnet external to said tube.

10. The tube of claim 1 wherein said grid is a perforated sheet of carbon.

11. The tube of claim 10 wherein said sheet is pyrolitic graphite.

12. The tube of claim 11 wherein said pyrolitic graphite is anisotropic and the directions of high conductivity of said pyrolitic graphite are in the surface of said sheet.

13. The tube of claim one wherein said means for applying said radio-frequency input signal comprises means for connecting said cathode and said grid coaxially to a coaxial resonant input cavity.

14. A method for increasing the efficiency of a beam tube employing density modulation and inductive output circuit, said tube comprising:

a vacuum envelope;

a gun for generating a linear beam of electrons, said gun comprising a thermionic cathode, means for heating said cathode, and an electron-permeable grid insulated from said cathode and spaced close to the emissive surface of said cathode;

means for applying a radio-frequency input signal voltage between said cathode and said grid;

anode means for drawing a beam of electrons from said gun, said anode means comprising an aperture for passage of said beam through an extended hollow metallic drift tube;

collector means beyond the end of said drift tube opposite said anode for collecting said electrons and dissipating their remaining energy;

output circuit means for extracting rf energy from said beam comprising, a transverse output gap in said drift tube, means for coupling a resonant output circuit across said gap, and means for extracting energy from said resonant output circuit;

a second gap in said drift tube on the anode side of said output gap, and means for coupling an intermediate resonant circuit across said second gap;

said method comprising:

applying an amplitude modulated input signal between said grid and said cathode;

applying dc accelerating voltage between said cathode and said anode;

applying dc bias voltage between said grid and said cathode such that the emission current is drawn over approximately one-half of each rf cycle;

tuning said output circuit so that its resonant frequency is approximately at the center of the frequency band of said input signal; and tuning said intermediate cavity so that its resonant frequency is above said frequency band.

15. The method of claim 14 wherein said dc bias voltage is zero.

* * * * *